US006796261B2

(12) United States Patent
Colyer

(10) Patent No.: US 6,796,261 B2
(45) Date of Patent: Sep. 28, 2004

(54) SUBSEA DEPLOYABLE DRUM FOR LAYING LINES

(75) Inventor: Angus Niall Colyer, Aude (FR)

(73) Assignee: ABB Offshore Systems, Inc., Houston, TX (US)

( * ) Notice: Subject to any disclaimer, the term of this patent is extended or adjusted under 35 U.S.C. 154(b) by 0 days.

(21) Appl. No.: 10/376,493

(22) Filed: Feb. 28, 2003

(65) Prior Publication Data

US 2003/0167997 A1 Sep. 11, 2003

Related U.S. Application Data

(60) Provisional application No. 60/360,262, filed on Feb. 28, 2002.

(51) Int. Cl.[7] ..... B63B 35/44
(52) U.S. Cl. ..... 114/258
(58) Field of Search ..... 114/258; 405/158–165, 405/168.3, 174, 180, 183, 184

(56) References Cited

U.S. PATENT DOCUMENTS 5,722,793 A * 3/1998 Peterson ..... 405/164
5,971,665 A 10/1999 Hughes
6,588,980 B2 * 7/2003 Worman et al. ..... 405/158

* cited by examiner

*Primary Examiner*—Jesus D. Sotelo
(74) *Attorney, Agent, or Firm*—Bracewell & Patterson, L.L.P.

(57) ABSTRACT

A method of deploying a subsea line utilizes a subsea deployment unit. A drum wrapped with the line is mounted to the unit. The unit is lowered on a cable into the sea from a surface vessel. An ROV is lowered on an umbilical into the sea and brought into engagement with the unit. The ROV provides thrust and guidance to move the unit along a desired path above the sea floor. The ROV also supplies power to the motor of the unit to cause the drum to rotate and deploy the line from the drum. The ROV disengages from the unit and connects the ends of the line to subsea components.

25 Claims, 6 Drawing Sheets

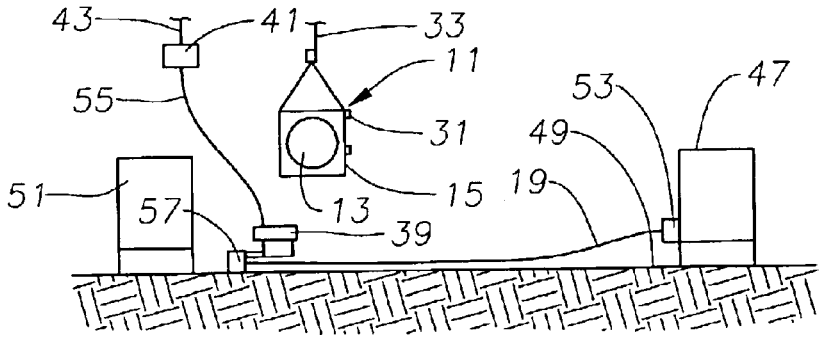
Fig. 3
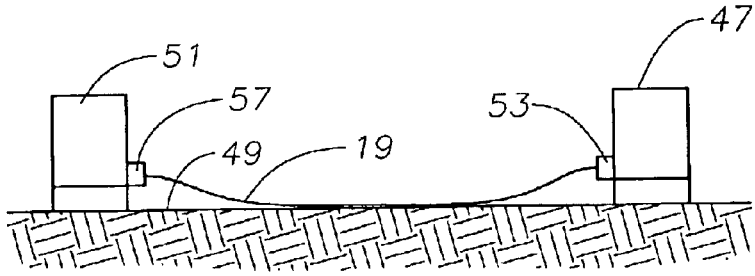
Fig. 4
Fig. 5
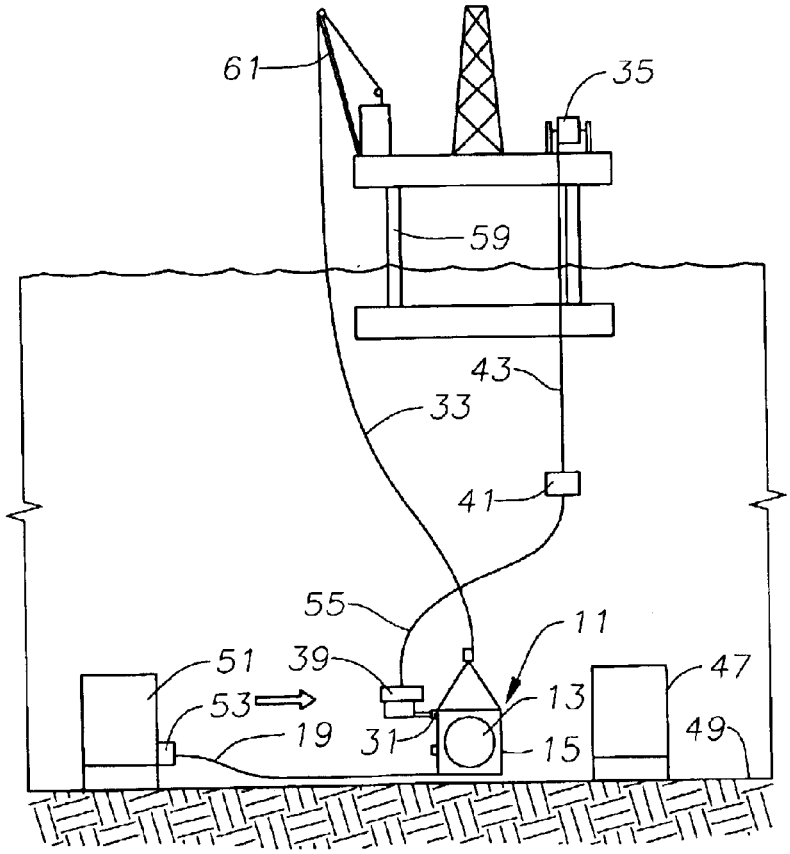

SUBSEA DEPLOYABLE DRUM FOR LAYING LINES

CROSS REFERENCE TO RELATED APPLICATIONS

This application claims the benefit of provisional patent application 60/360,262, filed Feb. 28, 2002.

FIELD OF THE INVENTION

This invention relates in general to subsea production systems, and in particular to an apparatus and method for connecting lines between subsea equipment using a subsea deployable drum.

BACKGROUND OF THE INVENTION

Subsea installations often require the deployment of lines between one subsea piece of equipment and another. These lines, often called jumpers, may extend from a subsea well to a pipeline end termination and surface production flowline. Also, they may provide electrical power, electrical communications, optical communications, hydraulic power and chemicals to subsea trees, manifolds and distribution units. Typical lengths may vary from 20 meters to 4 kilometers, and cross-sections of lines or bundles of lines may be as much as 100 mm. in diameter. Typically, such lines are installed from a reel located on a pipeline laying vessel at the surface. Normally, such lines have a tensile armor exterior to protect them during installation.

SUMMARY OF THE INVENTION

A method of deploying a line subsea is provided in this invention that includes wrapping a length of line onto a rotatable drum of a deployment unit. The unit is lowered into the sea from a surface vessel. Then the drum is rotated to deploy the line. In the preferred method, the first end of the line is connected to a first subsea component, then the line is then removed entirely from the drum, and the second end of the line is connected to a second subsea component.

Preferably, the drum is powered and the unit is guided by an ROV (remote operated vehicle) that is lowered into the sea from the surface vessel on an umbilical line. The ROV stabs into an interface on the unit to provide the power to rotate the drum. The ROV also supplies thrust to move the unit horizontally while the line is being deployed. Further, the ROV disengages from the unit and connects the first and second ends to the subsea assemblies.

In one embodiment, the unit has a quick release upper section that releases from the lower section. The motor and controls interface are mounted to the upper section while the drum is mounted to the lower section. In the event of an emergency or malfunction, the ROV disconnects fasteners that fasten the upper and lower sections to each other. This allows the upper section and motor to be retrieved while the lower section and drum remain on the sea floor.

BRIEF DESCRIPTION OF THE DRAWINGS

FIG. 3 illustrates the line of FIG. 2 shown entirely removed from the deployment unit and prior to connection of its second end with a second subsea assembly.

FIG. 4 shows both ends of the line connected to sub sea assemblies, and the deployment unit and ROV removed.

FIG. 5 illustrates an alternate method of this invention, showing a stationary vessel at the surface and showing the ROV being used as a tow to move the deployment unit from the proximity of one subsea assembly to another.

DETAILED DESCRIPTION OF THE INVENTION

Figure 1:
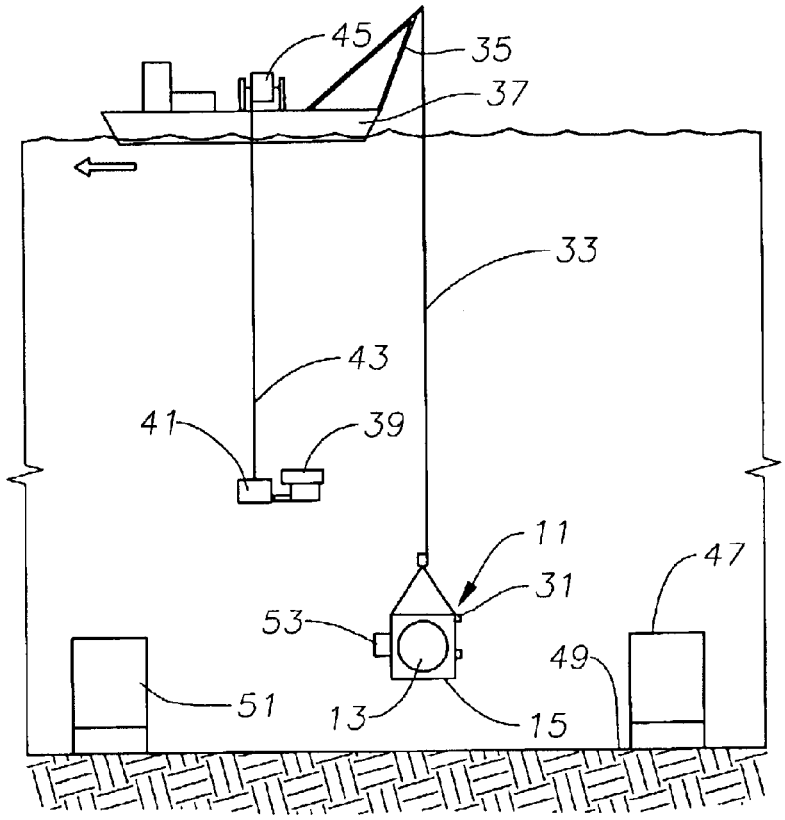
FIG. 1 is a schematic view illustrating a deployment unit in accordance with this invention being lowered into the sea, and an ROV and its support equipment also being lowered into the sea.
Figure 2:
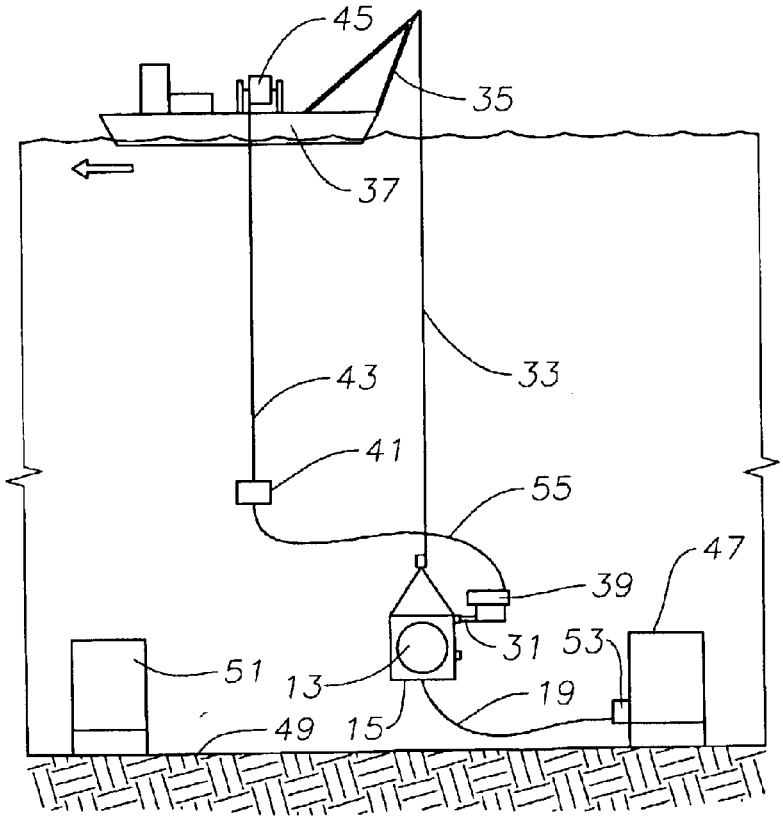
FIG. 2 illustrates the ROV unit being docked with the deployment unit of FIG. 1 after the first end of a line has been connected to a first subsea assembly.

Referring to FIGS. 1 and 2, deployment unit 11, which is schematically shown, has a rotatable drum 13. Drum 13 is mounted in a lightweight frame 15. A jumper or line 19 (FIG. 2) is shown being unwound from drum 13. Line 19 is a tubular member for housing a variety of lines, such as those for supplying electrical power, electrical communications, optical communications, hydraulic power and/or chemicals between subsea trees, manifolds and distribution units. Line 19 may also be a seismic line that contains acoustical sensors that are deployed on the sea floor for sensing vibrations within the earth. Line 19 may be thermoplastic or it may be a steel tubing capable of being wound around drum 13. Line 19 typically has a length from about 20 meters to 4 kilometers. It may have a cross-section up to 100 mm in diameter or more. The ends of line 19 are normally sealed. A pressure compensator (not shown) may be mounted to line 19 to equalize its interior pressure to the hydrostatic pressure.

It is preferred that drum 13 have a power unit, such as a hydraulic motor (not shown in this embodiment), for rotating drum 13. An ROV (remote operated vehicle) interface 31 is mounted to frame 15. Deployment unit 11 is lowered on a lift cable 33 from a crane or an A-frame 35 on a support vessel 37. Support vessel 37 in this embodiment is not normally a drilling vessel, and it is readily capable of moving from one location to another while deployment unit 11 is subsea.

An ROV (remote operated vehicle) 39 is shown also being lowered into the sea from support vessel 37. ROV 39 is an unmanned, self-propelled submarine that has a video camera, and an arm, and possibly other instruments for performing a variety of tasks. ROV 39 is controlled and supplied with power from support vessel 37. ROV 39 is connected to an ROV tether management system or unit 41 that is connected to support vessel 37 by means of an umbilical or cable 43 that supplies electrical power, communications and/or hydraulic power. Umbilical 43 is lowered from a reel 45 that is mounted to the deck of support vessel 37. An operator on surface vessel 37 will control the movement and operations of ROV 39. Preferably ROV 39 is conventional and is coupled to a special purpose skid (not shown in this embodiment) that contains the valves and electrical circuitry for controlling the hydraulic motors on deployment unit 11. Alternately, the valves and circuitry could be mounted to the ROV interface 31.

A first subsea assembly 47 is schematically illustrated on sea floor 49 and a second subsea assembly 51 also located on sea floor 49 but at some distance away. The distance might be from about 20 meters to 4 kilometers or more. Subsea assemblies 47 and 51 may be of a variety of types of subsea equipment that require communication, chemicals, electrical and the like. For example, subsea assemblies might be subsea trees, manifolds or distribution units. One may be a subsea tree and the other a pipeline end termination. Also, in the case of a seismic line, one of the subsea assemblies 47 or 51 could be an assembly for supplying power to line 19 and transmitting signals to a remote facility. The seismic line would remain on the sea floor for long term monitoring through three-dimensional seismic techniques.

In FIG. 1, line 19 (FIG. 2) is wrapped completely around drum 13 with one end termination 53 located on the outside of frame 15. Referring to FIG. 2, ROV 39 is shown separated from its management unit 41 and landed on ROV interface 31 on frame 15. A tether 55 connects ROV 39 with management unit 41. FIG. 2 also illustrates end 53 of line 19 connected to first subsea assembly 47. The connection has been performed by ROV 39.

FIG. 3 illustrates deployment unit 11 moved over in close proximity to second subsea assembly 51 after first end 53 has been connected to first subsea assembly 47. It shows the entire line 19 removed from drum 13. Second end 57 is in the process of being engaged by ROV 39. FIG. 4 shows second end 57 coupled to second subsea assembly 51, and ROV 39 and deployment unit 11 retrieved to the surface.

In the operation of the first embodiment, each line 19 is manufactured a desired length with couplings on both ends 53 and 57 (FIG. 3). Line 19 will be wound around drum 13. Support vessel 37 will then lower deployment unit 11 into the sea, as illustrated in FIG. 1. In one technique, deployment unit 11 will be lowered on lift line 33 to about 50 meters above the sea floor. ROV 39 and its management unit 41 will be lowered into the sea on umbilical 43 from reel 45. ROV 39 will be unlatched from its management unit 41 and moved into engagement with interface 31 on deployment unit 11. With the assistance of positioning information provided by ROV 39, support vessel 37 will lower unit 11 closer to sea floor 49 and also position deployment unit 11 fairly close to first subsea assembly 47.

ROV 39 will then operate the hydraulic motor to cause the drum 13 to unwind a sufficient length of line 19 to reach first subsea assembly 47. ROV 39 then detaches itself from interface 31 and moves into engagement with first end 53 of line 19. ROV 39 then flies first end 53 over and couples it to first subsea assembly 47. ROV 39 then moves back to deployment unit 11 and re-engages ROV interface 31. This is the position shown in FIG. 2. Deployment unit 11 remains stationary while the above steps are carried out by ROV 39.

Line 19 is then laid on the sea floor 49 along a defined route using a combination of movement of surface vessel 37 as well as thrust power and guidance from ROV 39. This is handled by rotating drum 13 to unreel line 19 as deployment unit 11 is moved from the proximity of first subsea assembly 47 to second subsea assembly 51. Deployment unit 11 is located a selected distance above sea floor 49 as it traverses from subsea assembly 47 to subsea assembly 51. Drum 13 is preferably driven by the hydraulic motor during this unreeling process, but for short distances, it could freewheel. The entire line 19 will be uncoiled from drum 13 as deployment unit 11 is moved. During this traversing movement of unit 11, an as-built survey may be made by ROV 39 and communicated back to surface vessel 37 to assure that line 19 has been deployed properly.

Then, ROV 39 detaches itself again from deployment unit 11 and moves over into engagement with second end 57, as illustrated in FIG. 3, which will normally be located on sea floor 47 after removal of line 19 from drum 13. ROV 39 flies line second end 57 to second subsea assembly 51 and connects it as illustrated in FIG. 4. Deployment unit 11 with the empty drum 13 is retrieved to surface vessel 37. ROV 39 and its management unit 41 are also retrieved to surface vessel 37. The same procedure may be used in reverse to retrieve previously installed lines.

In the alternate method of FIG. 5, the same type of subsea equipment may be employed as in the first embodiment, however a surface vessel 37 that is readily movable to move deployment unit 11 from the vicinity of first subsea assembly 47 to second subsea assembly 51 is not used. Instead, a platform 59, such as a mobile offshore drilling unit, is located at the surface. Platform 59 is normally secured in position by tension legs or anchor lines, thus is not readily movable from above subsea assembly 47 to subsea assembly 51. In this embodiment, deployment unit 11 is typically lowered into the sea from a crane 61 to a position generally between subsea assemblies 47, 51. The method is similar to that described above except deployment unit 11 is moved from one subsea assembly 47, 51 to another by thrust from ROV 39 and not any movement of platform 59. A second ROV (not shown) could be employed to connect the ends of line 19 to the subsea assemblies 47, 51 while the first ROV remains attached to deployment unit 11 to hold it in position. Alternately, as shown in FIG. 5, the operator could place deployment unit 11 on sea floor 49 during the time that ROV 39 is disengaged from deployment unit 11 and prior to connecting either end of line 19 to one of the subsea assemblies 47, 51.

In the position shown in FIG. 5, initially, ROV 39 was used to position deployment unit 11 close to second subsea assembly 51, then deployment unit cable 33 was lowered to cause deployment unit 11 to sit on sea floor 49. While deployment unit 11 rests on sea floor 49, ROV 39 unwinds a portion of line 19, detaches itself from interface 31, picks up first end 53, and couples it to the second subsea assembly 51. Then, ROV 39 is redocked on deployment unit 11.

Utilizing lift line 33 and ROV 39, deployment unit 11 is then lifted from the sea floor a selected distance and propelled by the thrust of ROV 39 toward first subsea assembly 47. While doing so, line 19 is unwound from drum 13, which is preferably driven, but could freewheel during the laying process. As in the first embodiment, the entire line 19 is unreeled from drum 13. ROV 39 then unlatches itself from deployment unit 11, picks up the second end (not shown in FIG. 5) and connects it to first subsea assembly 47. Deployment unit 11 need not be on the sea floor while ROV 39 is connecting second end 57 because the entire line 19 will have been removed from deployment unit 11 before ROV 39 is undocked from interface 39. If desired, deployment unit 11 could be retrieved on lift line 33 once ROV 39 undocks itself from interface 31 and before picking up the second end of line 19. Of course, the operator could have first connected line 19 to first subsea assembly 47 rather than initially to second subsea assembly 53.

Figure 6:
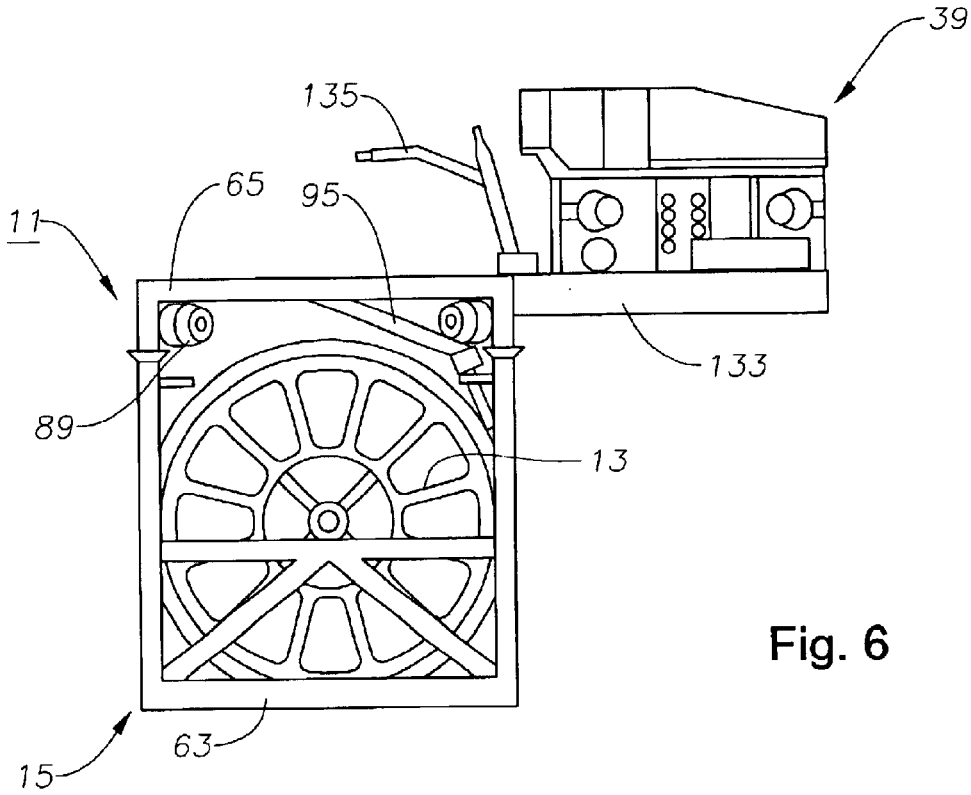
FIG. 6 is a side view of a more detailed embodiment of the deployment unit of FIG. 1, shown connected with an ROV.
Figure 7:
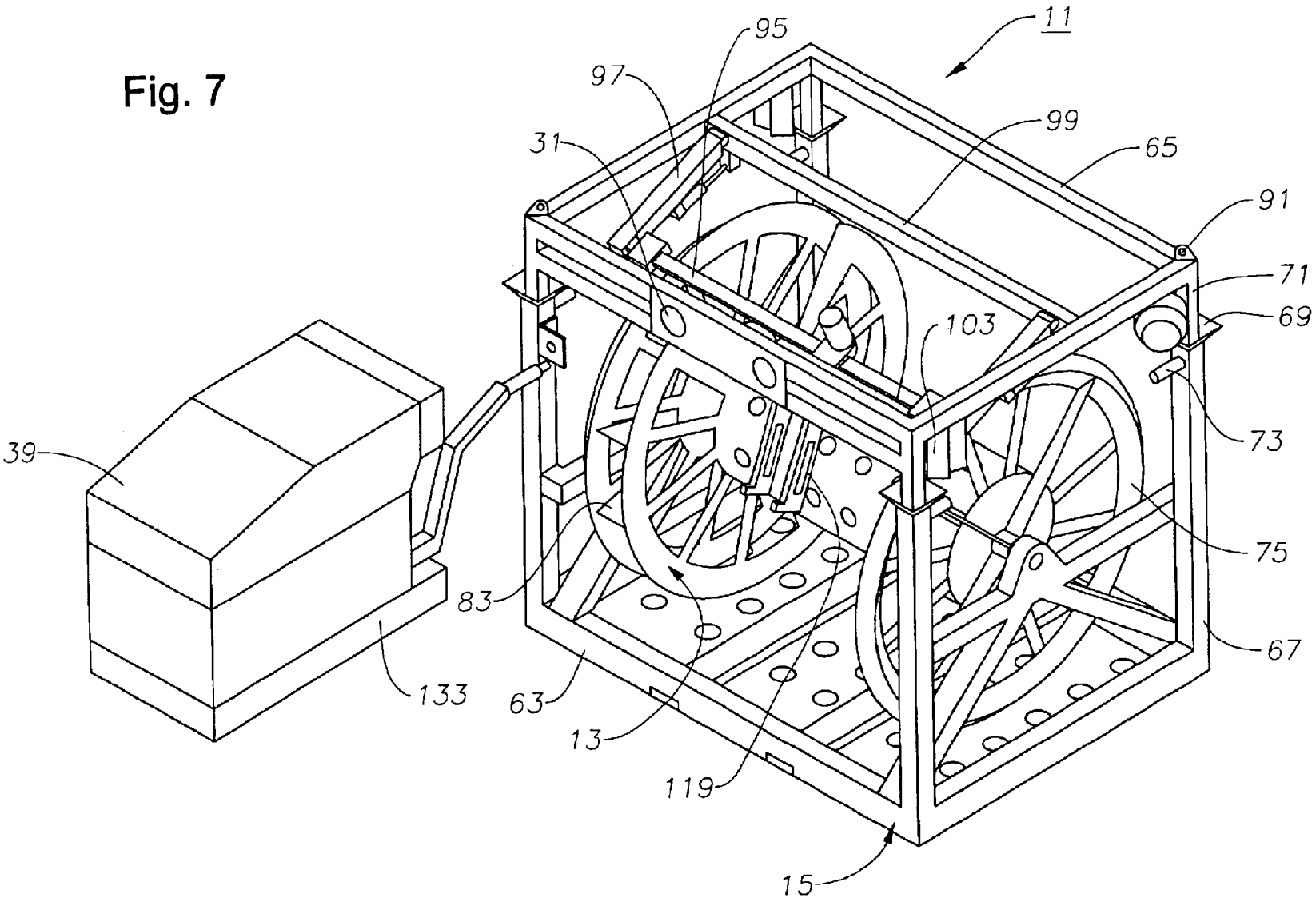
FIG. 7 is an isometric view of the deployment unit of FIG. 6, showing the ROV disconnected.

FIGS. 6–12 illustrate more detailed versions of the deployment unit and ROV shown in FIGS. 1–5. Referring to FIG. 7, frame 15 includes a lower frame section 63 and an upper frame section 65. Both frame sections 63, 65 are rectangular in this embodiment. Lower frame section 63 has four legs 67 that extend upward and terminate in funnels 69. Each leg 67 is hollow for receiving one of the legs 71 of upper frame section 65. Legs 71 are preferably unequal in length to facilitate stabbing back into legs 67. As shown more clearly in FIG. 8, a plurality of "J" latch retaining pins or fasteners 73 are movable between a locked position, locking legs 71 and 67 together, and a released position. Pins 73 are moved between the locked and released positions by ROV 39 (FIG. 6).

Figure 8:
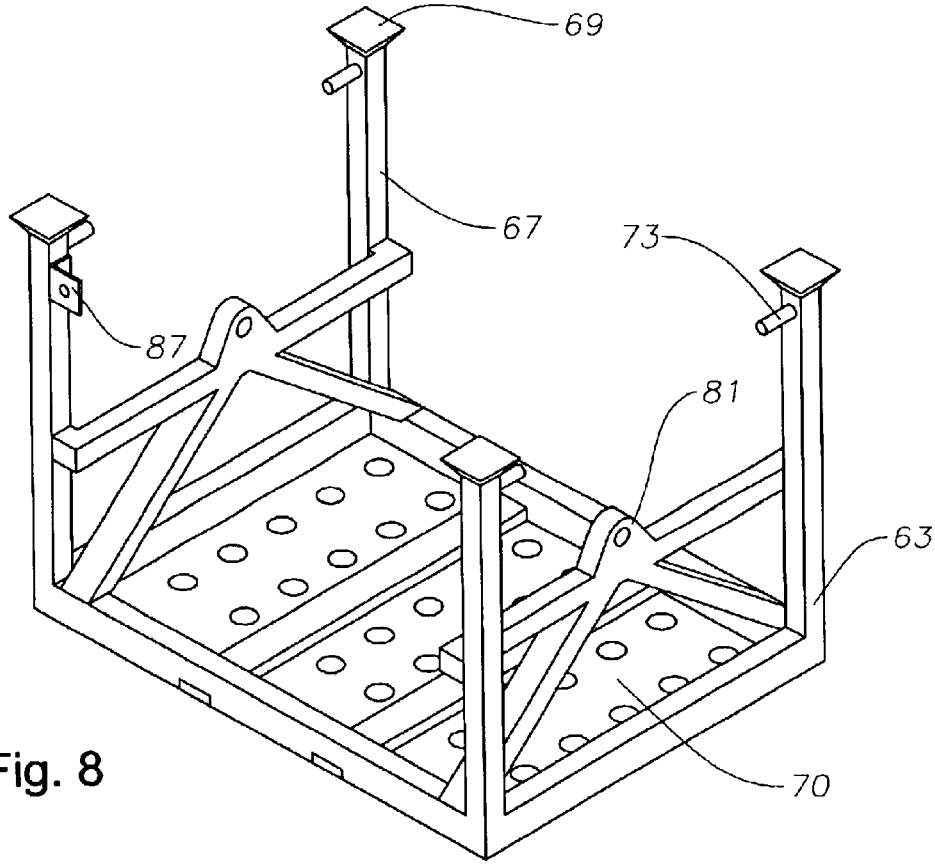
FIG. 8 is an isometric view of the lower frame section of the deployment unit of FIG. 6.
Figure 10:
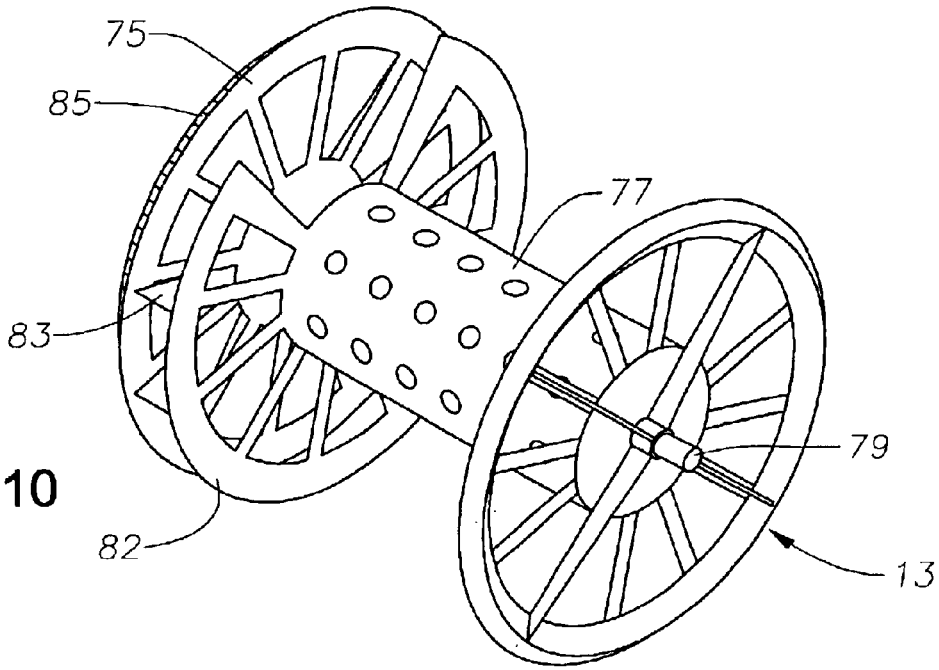
FIG. 10 is an isometric view of the drum for the deployment unit of FIG. 6.

Referring to FIG. 10, drum 13 has a pair of flanges 75 that are parallel to each other and secured together by a horizontal cylindrical hub 77. An axle 79 extends through hub 77 and protrudes from each end. Axle 79 mounts in bearings 81 (FIG. 8) located on lower frame section 63. A stab plate 82 is located inward from and parallel to one of the flanges 75 to form an annular partition for storing the second termination end 57 of line 19 (FIG. 4). Baffles 83 are located between stab plate 82 and flange 75 to facilitate storage. Second end 57 is hinged to locate within the partition provided by stab plate 82 and baffles 83. First end 53 of line 19 (FIG. 2) secures to a bracket 87 mounted to one of the legs 67 of lower frame 63, as shown in FIG. 8. At least one, and preferably both flanges 75 has a ring gear 85 mounted on the rim for rotating drum 13. The teeth of ring gear 85 are located on its outer diameter.

Figure 9:
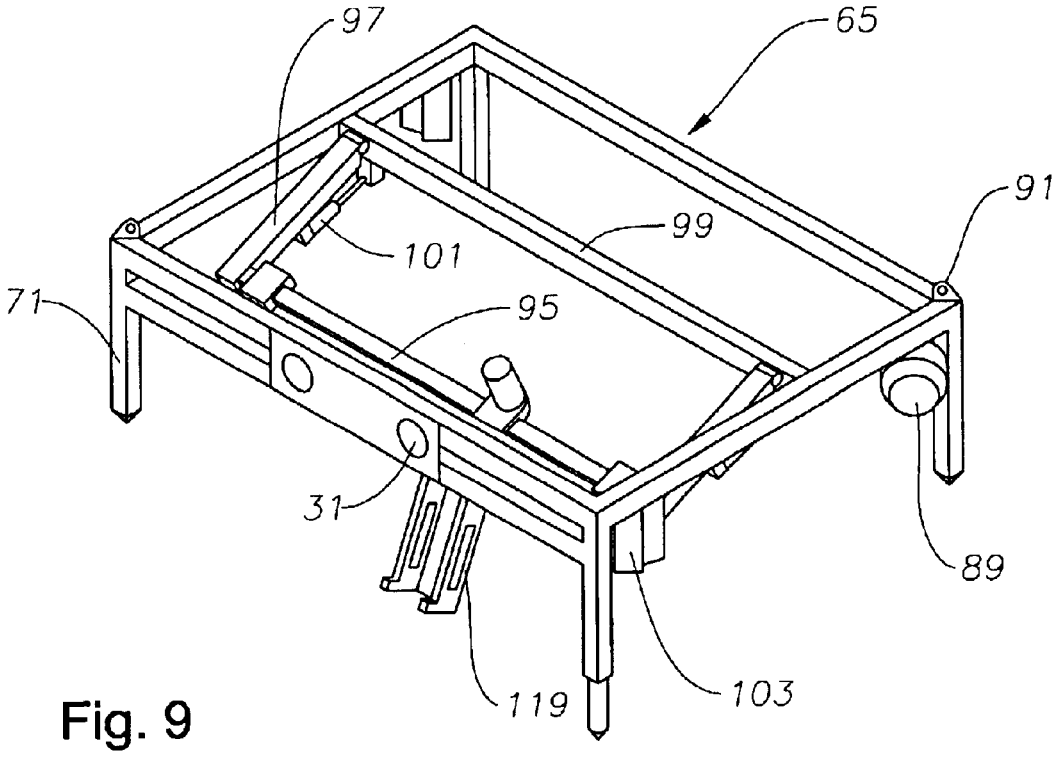
FIG. 9 is an isometric view of the upper frame section of the deployment unit of FIG. 6.

Referring to FIG. 9, upper frame section 65 may have optional thrusters 89 for supplying thrust to assist in the positioning of the deployment unit 11. Thrusters 89 function as propellers, may be mounted to each leg 71, and are powered by ROV 39 (FIG. 6). A plurality of pad eyes 91 are mounted to the upper side of upper frame section 65. A lift sling (not shown) made up of chain legs and a top mounted swivel connects pad eyes 91 to cable 33 (FIG. 1). ROV interface 31 is mounted to one side of upper frame section 65. ROV interface 31 has attachment points for hydraulic connections.

An arm 95 extends across the width of upper frame section 65. Arm 95 is secured by a pair of legs 97 to a beam 99 that extends across the width of upper frame section 65. Legs 97 are pivotally connected to beam 99 so that arm 95 can move from a lower engaged position, shown in FIG. 9, to an upper retracted position wherein arm 95 is generally in a plane parallel with the upper side of upper frame section 65. A pull wire with a ball and a keyhole latching mechanism (not shown) is mounted to arm 95 and upper frame section 65 to releasably hold arm 95 in the upper retracted position. When the pull wire is actuated by ROV 39, arm 95 swings downward by gravity to the lower engaged position. Shock absorbers 101 connect between upper frame section 65 and arm 95 to dampen downward movement of arm 95 when arm 95 is released from the upper position to move downward.

Figure 11:
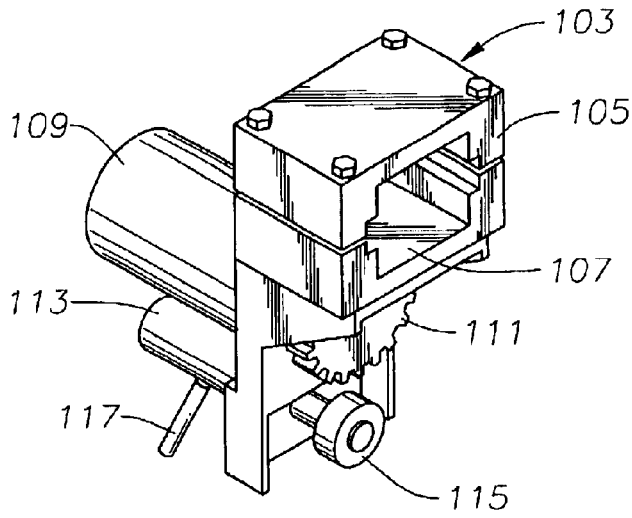
FIG. 11 is an isometric view of one of the motors for driving the drum of the deployment unit of FIG. 6.

At least one motor assembly 103, and preferably two for redundancy, is mounted to arm 95. Each motor assembly 103 is mounted near an opposite end of arm 95. Referring to FIG. 11, each motor assembly 103 has a bracket 105 made up of two halves that bolt together, each half having a channel to define a receptacle 107 for clamping to arm 95 (FIG. 9). When bolted together, bracket 105 clamps motor assembly 103 rigidly to arm 95. Brackets 105 can be loosened to allow the motor assemblies 103 to be repositioned on arm 95 for differing widths of drums 13 (FIG. 10).

Each motor assembly 103 preferably includes an upper hydraulic motor 109 that rotates a gear 111. Gear 111 meshes with the teeth of ring gear 85 (FIG. 10) on drum 13. Also, each motor assembly 103 preferably has a lower hydraulic motor 113. Lower hydraulic motor 113 rotates a frictional wheel 115 that engages an inner diameter of ring gear 85, trapping ring gear 85 between wheel 15 and gear 111. Hydraulic motors 109 and 113 are reversible and serve also as a brake to prevent rotation of drum 13. A retracting mechanism 117 enables wheel 115 to retract laterally away from ring gear 85 for installing and removing motor assembly 103 from ring gear 85.

Figure 12:
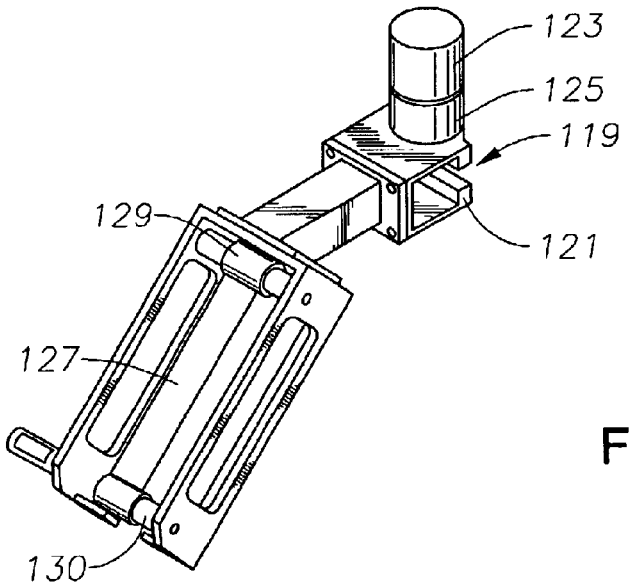
FIG. 12 is an isometric view of a level wind mechanism of the deployment unit of FIG. 6.
Figure 13:
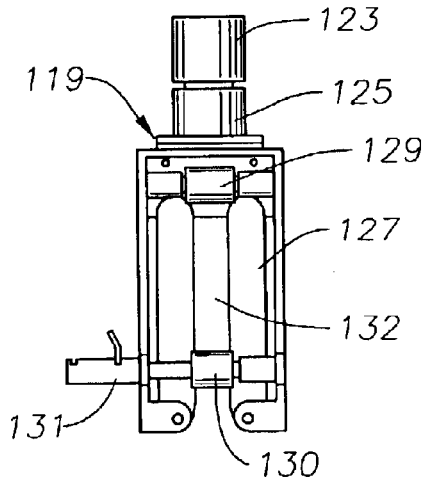
FIG. 13 is a front view of the level wind mechanism of FIG. 12.

An optional level wind assembly 119 is best shown in FIGS. 12 and 13. Level wind assembly 119 is normally not needed for deploying line 19 (FIG. 1), but may be needed for winding line 19 back on in the event that line 19 is recovered. Level wind assembly 119 has a trunnion bracket 121 that mounts to arm 95 (FIG. 9) and has slide bearings within it to facilitate sliding along arm 95. A hydraulic motor 123 connects to a gear box 125 for driving a rotary drive member (not shown) that is located within trunnion bracket 121. Hydraulic motor 123 will selectively cause level wind assembly 119 to move from one end of arm 95 (FIG. 10) to the other by causing its drive member to roll along arm 95.

In this embodiment, level wind assembly 119 includes a pair of upright spaced apart guides 127 and upper and lower horizontal guides 129, 130 that are spaced vertically apart to define an aperture 132 through which lines 19 (FIG. 1) extends. A retractor mechanism 131, when actuated, will pull the lower horizontal guide 130 outwardly to enable line 19 to be placed within or removed from aperture 132.

Referring back to FIG. 6, a control skid or package 133 is shown attached to ROV 39. ROV 39 is preferably conventional, and control package 133 contains all of the necessary solenoids and valves for controlling the various hydraulic motors of unit 11. Control package 133 is coupled to ROV 39 at the surface and lowered together as a unit. Optionally control package 133 could be mounted to upper frame section 65. ROV 39 has a conventional movable arm 135 for performing various tasks.

In operation, the embodiment shown in FIGS. 6–13 operates in the same manner as the first embodiment. Frame 15 is lowered as a unit on cable 33 (FIG. 1). Control package skid 133 is attached to ROV 39 on vessel 37 (FIG. 1) or platform 59 (FIG. 5) and lowered on umbilical 43 (FIG. 1). ROV 39 maneuvers to deployment unit 11, and control package skid 133 docks to ROV interface 31.

If while deploying line 19, a malfunction occurs in deployment unit 11 while in the process of laying or recovering line 19, the operator can retrieve all of the hydraulic motors and controls for repair or replacement without having to rewind line 19 back onto drum 13. Also, in the event a storm or other emergency occurs while unit 11 has only partially completed laying or recovering line 19, the hydraulic motors and controls can be retrieved without disturbing the work in progress.

In the event of a malfunction or emergency, the operator lowers deployment unit 11 to the sea floor and disengages ROV 39 from interface 31. The operator then would utilize ROV 39 and its arm 135 to actuate retractor mechanism 117 (FIG. 11) to pull wheel 115 of each motor assembly 103 laterally outward. If level wind assembly 119 is mounted to frame arm 95, ROV 39 is utilized to actuate retract mechanism 131 to pull lower horizontal guide 130 laterally outward. ROV arm 135 then lifts frame arm 95 (FIG. 9) to the upper position, and the latch (not shown) will snap into engagement to hold arm 95 in the upper position. When arm 95 moves to the upper position, level wind assembly 119 will disengage from line 19 (FIG. 1) and motor assemblies 103 (FIG. 11) will disengage from ring gears 85. ROV arm 135 is also deployed to release pins 73 (FIG. 7) from each leg 67 of lower frame section 63. The operator then pulls upward on cable 33 (FIG. 1), which causes upper frame section 65 to pull out of lower frame section 63. Lower frame section 63 will rest on the sea floor along with drum 13 and line 19 while ROV 39, controls package 133, and upper frame section 65 will be retrieved to the surface. Motor assemblies 103 and level wind assembly 119, if any, will be retrieved along with upper frame section 65.

After replacement or repair at the surface vessel, the operator lowers upper frame section 65 back into engagement with lower frame section 63 (FIG. 7). The unequal lengths of legs 71 facilitate stabbing into funnels 69 of lower frame legs 67. ROV 39 then reverses the process described above to secure upper frame section 65 to lower frame section 63 and engage motor assemblies 103 with ring gears 85.

The invention has significant advantages. Since the line is unreeled from a subsea drum rather than a drum on a surface vessel, the line may be manufactured without a tensile armor layer, which otherwise would be needed for deep water. Smaller surface vessels may be used to deploy longer lengths of line than in the prior art. The line may be deployed along a predefined and accurate corridor, which often cannot be achieved when the line is unreeled from a surface vessel. The method allows simultaneous installation and an as-built survey of the installation. The light weight of the drum and line enables a work class ROV to push the assembly underneath the surface vessel. The unreeling from the drum is accomplished with the deployment unit located above the sea floor, reducing loose seabed conditions from being stirred up. Larger cross-sections of the lines can be attained than in the prior art since displacement is not induced into the line. This method removes the dependence on the use of large and specialized surface vessels to deploy long lines and umbilicals.

While the invention has been shown in only three of its forms, it should be apparent to those skilled in the art that it is not so limited but is susceptible to various changes without departing from the scope of the invention.

I claim:

1. A method of deploying a line subsea, comprising:

(a) wrapping a length of line onto a rotatable drum of a deployment unit;

(b) securing a cable to the unit and lowering the unit into the sea from a surface vessel; and (c) causing the drum to rotate and deploy the line, and removing the line entirely from the drum, and retrieving the unit with the cable while the line remains subsea.

2. A method of deploying a line subsea, comprising:

(a) wrapping a length of line onto a rotatable drum of a deployment unit:

(b) securing a cable to the unit and lowering the unit into the sea from a surface vessel: and (c) causing the drum to rotate and deploy the line, and connecting a first end of the line to a first subsea component, removing the line entirely from the drum, then connecting a second end of the line to a second subsea component.

3. A method of deploying a line subsea, comprising:

(a) wrapping a length of line onto a rotatable drum of a deployment unit;

(b) securing a cable to the unit and lowering the unit into the sea from a surface vessel, and providing thrust from the ROV to position the unit at desired positions;

(c) lowering an ROV into the sea from the surface vessel and engaging the ROV with the unit; and (d) causing the drum to rotate and deploy the line.

4. A method of deploying a line subsea, comprising:

(a) wrapping a length of line onto a rotatable drum of a deployment unit;

(b) securing a cable to the unit and lowering the unit into the sea from a surface vessel;

(c) lowering an ROV into the sea from the surface vessel and engaging the ROV with the unit; and (d) causing the drum to rotate and deploy the line by supplying power from the ROV.

5. A method of deploying a line subsea, comprising:

(a) wrapping a length of line onto a rotatable drum of a deployment unit:

(b) securing a cable to the unit and lowering the unit into the sea from a surface vessel;

(c) lowering an ROV into the sea from the surface vessel;

(d) causing the drum to rotate and deploy the line;

(e) engaging the ROV with a first end of the line and, with the assistance of the ROV, connecting the first end of the line to a first subsea component located on the floor of the sea; then (f) moving the unit toward a second subsea component on the floor of the sea while deploying the line from the drum; then (g) engaging the ROV with a second end of the line and, with the assistance of the ROV, connecting the second end of the line to the second subsea component.

6. A method of deploying a line subsea, comprising:

(a) wrapping a length of line onto a rotatable drum of a deployment unit;

(b) securing a cable to the unit and lowering the unit into the sea from a surface vessel;

(c) causing the drum to rotate and deploy the line; and (d) moving the surface vessel generally horizontally to cause the unit to move in a horizontal direction while deploying the line.

7. A method of deploying a line subsea, comprising:

(a) wrapping a length of line onto a rotatable drum of a deployment unit;

(b) securing a cable to the unit and lowering the unit into the sea from a surface vessel;

(c) causing the drum to rotate and deploy the line; and (d) maintaining the surface vessel in a generally stationary position and supplying thrust to the unit subsea to move the unit generally horizontally while deploying the line.

8. A method of deploying a subsea line, comprising:

(a) wrapping a length of line onto a drum of a deployment unit, the drum being rotatably driven by a motor;

(b) securing a cable to the unit and lowering the unit into the sea from a surface vessel;

(c) lowering an ROV on an umbilical into the sea and engaging the ROV with the unit; then (d) providing thrust from the ROV to move the unit along a desired path above the sea floor; and (e) supplying power from the ROV to the motor of the unit to cause the drum to rotate and deploy the line from the drum; then (f) once all of the line is deployed from the drum, retrieving the unit with the cable.

9. The method according to claims 8, further comprising disengaging the ROV from the unit, and with the assistance of the ROV, connecting a first end of the line with a first subsea component.

10. The method according to claim 8, wherein step (d) and step (e) occur simultaneously.

11. The method according to claim 8, further comprising:

prior to completing step (e) disengaging the ROV from the unit, and with the assistance of the ROV, connecting a first end of the line with a first subsea component; then, completing step (e); then disengaging the ROV from the unit and with the assistance of the ROV, connecting a second end of the line with a second subsea component.

12. The method according to claim 8, wherein step (a) comprises providing the deployment unit with upper and lower sections, the motor being mounted to the upper section and the drum being mounted to the lower section, the upper and lower sections being releasable from each other; and wherein the method further comprises:

in the event of a malfunction or emergency prior to completing step (e), setting the unit on the sea floor;

disengaging the ROY from the unit and employing the ROY to disconnect the upper and lower sections from each other; then retrieving the upper section and the motor with the cable while the lower section, the drum and the line remain on the sea floor.

13. A method of connecting a line from a first subsea component located on a sea floor to a second subsea component located on the sea floor, comprising:

(a) wrapping a length of line onto a rotatable drum of a deployment unit;

(b) securing a cable to the unit and lowering the unit into the sea from a surface vessel to a point adjacent the first subsea component;

(c) lowering an ROV into the sea and with the assistance of the ROV, connecting the first end of the line to the first subsea component; then (d) moving the unit to a point adjacent the second subsea component; and (e) while moving the unit, causing the drum to rotate and deploy the line from the drum; then (f) with the assistance of the ROV, connecting a second end of the line to the second subsea component.

14. The method according to claim 13, wherein step (a) further comprises providing the drum with a motor; and step (b) comprises supplying power to the motor from the ROV.

15. The method according to claim 13, wherein step (a) further comprises providing the deployment unit with upper and lower sections, mounting a motor to the upper section that releasably engages the drum to rotate the drum, the drum being mounted to the lower section, the upper and lower sections being releasable from each other; and wherein the method further comprises:

in the event of a malfunction or emergency prior to completing step (f), setting the unit on the sea floor;

disengaging the ROV from the unit and employing the ROV to disconnect the upper and lower sections from each other; then retrieving the upper section and the motor with the cable while the lower section, the drum and the line remain on the sea floor.

16. The method according to claim 13, further comprising retrieving the unit with the cable after step (f) while leaving the line connected to the first and second components.

17. The method according to claim 13, wherein step (c) comprises supplying thrust from the ROV.

18. The method according to claim 13, wherein step (d) comprises moving the surface vessel generally horizontally to cause the unit to move from adjacent the first component to adjacent the second component.

19. A deployment unit for deploying line subsea, comprising:

a frame adapted to be secured to a cable for lowering subsea;

a drum rotatably mounted to the frame for receiving a length of a line for deploying subsea;

a hydraulic motor cooperatively engaged with the drum for rotating the drum; and a controls interface mounted to the frame for supplying power to and controlling the motor, the interface adapted to be engaged by an ROV lowered into the sea on an umbilical for supplying thrust to guide the deployment unit and power to operate the motor.

20. The deployment unit according to claim 19, wherein the frame comprises:

an upper section releasably mounted to a lower section, the motor and the controls interface being mounted to the upper section, and the drum being mounted to the lower section; and a fastener adapted to be engaged by the ROV for releasing the upper section from the lower section to enable the upper section, the motor and the controls interface to be retrieved while the lower section and drum remain on the sea floor.

21. A deployment unit for deploying line subsea, comprising:

a lower frame having a plurality of upward extending legs;

an upper frame having a plurality of downward extending legs that telescope into engagement with the upward extending legs, the upper frame adapted to be connected to a cable for lowering the unit into the sea;

a drum rotatably mounted to the lower frame for receiving a length of a line for deploying subsea;

a hydraulic motor carried by the upper frame and cooperatively engaged with the drum for rotating the drum;

a controls interface mounted to the upper frame, the interface adapted to be engaged by an ROV lowered into the sea on an umbilical for supplying thrust to guide the deployment unit and power to operate the motor; and at least one fastener for securing the legs of the lower frame to the legs of the upper frame, the fastener adapted to be released by the ROV to enable the upper frame, the motor and the controls interface to be retrieved on the cable while the lower frame, the drum and the line remain subsea.

22. The unit according to claim 21, wherein the drum comprises a pair of flanges connected by a hub, and wherein the unit further comprises:

a plurality teeth extending around at least one of the flanges; and a gear connected with the motor that releasably engages the teeth to rotate the drum.

23. The unit according to claim 22, further comprising an arm pivotally mounted to the upper frame, the motor being mounted to the arm; and wherein the arm is movable to an upper position relative to the upper frame to disengage the gear of the motor from the teeth of the drum.

24. The unit according to claim 21, further comprising:

an arm carried by the upper frame and extending across the drum; and a level wind assembly mounted to the arm for movement along the arm to align wraps of the line on the drum in the event the line is wound back onto the drum.

25. The unit according to claim 22, wherein the motor is mounted to the arm, the motor having a drive member that engages a flange of the drum to rotate the drum; and wherein the arm is pivotal relative to the frame for disengaging the drive member of the motor from the flange of the drum.

* * * * *

UNITED STATES PATENT AND TRADEMARK OFFICE

CERTIFICATE OF CORRECTION

PATENT NO. : 6,796,261 B2
DATED : September 28, 2004
INVENTOR(S) : Angus Niall Colyer It is certified that error appears in the above-identified patent and that said Letters Patent is hereby corrected as shown below:

Column 9,
Lines 27 and 28, delete "ROY" and insert -- ROV --

Column 10,
Line 64, insert -- of -- after "plurality"

Signed and Sealed this

First Day of February, 2005

JON W. DUDAS
*Director of the United States Patent and Trademark Office*